United States Patent [19]

Maros

[11] Patent Number: 4,566,745

[45] Date of Patent: Jan. 28, 1986

[54] CONNECTOR ASSEMBLY

[75] Inventor: Ronald R. Maros, Itasca, Ill.

[73] Assignee: Cooper Industries, Inc., Houston, Tex.

[21] Appl. No.: 642,384

[22] Filed: Aug. 20, 1984

[51] Int. Cl.[4] ..... H01R 13/652

[52] U.S. Cl. ..... 339/14 P; 339/143 R

[58] Field of Search ..... 339/14 R, 14 P, 143 R, 339/177 R, 177 E, 223 R, 276 R, 276 D, 276 T

[56] References Cited

U.S. PATENT DOCUMENTS

| | | | |
|---|---|---|---|
| 2,815,497 | 12/1957 | Redslob | 339/276 |
| 3,828,298 | 8/1974 | Schumacher | 339/14 R |
| 3,860,316 | 1/1975 | Hardesty | 339/91 R |
| 3,953,103 | 4/1976 | Mathis | 339/276 T |

OTHER PUBLICATIONS

"Cable Braid Termination with Braid Pic", Bukowski, D. J., 10th Annual Connector Symposium, Oct. 19–20, 1977.

*Primary Examiner*—John McQuade

*Attorney, Agent, or Firm*—Fitch, Even, Tabin & Flannery

[57] ABSTRACT

A connector assembly for use in interconnecting a pair of electrical components. The assembly includes a connector having an insulative housing defining a connection chamber and a cable-receiving passageway communicating with the chamber. The connector further includes at least one metallic terminal element disposed in the chamber with the element having a conductor termination portion and a component connection portion. The assembly further includes a cable positioned in the passageway with the cable including a metallic conductor engaged by the conductor termination portion of the element, with an insulative jacket disposed about the conductor. Finally, the assembly includes a metallic band, at least partially encompassing the cable, positioned in the passageway and electrically isolated from the terminal element. The present invention also includes a method of forming the conductor assembly.

10 Claims, 5 Drawing Figures

CONNECTOR ASSEMBLY

BACKGROUND OF THE INVENTION

The present invention relates to a connector assembly for use in interconnecting a pair of electrical components and, more particularly, to such a connector assembly which provides a grounding connection for a shielded cable.

Modular plugs have been coming into increasing commercial prominence, particularly in the telephone field where they are used in the connection of cords from the wall outlet to the telephone base and from the base to the handset. Such plugs typically have a one-piece plastic housing defining a chamber wherein the various cable conductors are contacted by portions of terminal elements. Other portions of these elements are exposed so that when the plug is inserted into the piece of equipment to be connected, each exposed portion is contacted by a corresponding terminal in that piece of equipment to complete the appropriate circuits. Such modular plugs are fast and simple in use and avoid the need to make individual screw connections within the piece of telephone equipment. It will be appreciated that such plugs have wide application for interconnecting other types of electrical equipment where fast connection and disconnection is desired.

It is often necessary to provide modular plugs with grounding systems where the plugs are used with shielded cable. Such a combination offers electromagnetic interference and radio frequency interference protection for equipment such as computers and their peripherals, video games and point-of-sale and process control equipment. A typical method of providing a grounding system included providing an aperture intersecting the cable passageway so that a grounding pin could be inserted, in an interference fit, over the top of the exposed shield thereby compressing the cable against the floor of the passageway. While this method worked reasonably well for a cable having a very small range of dimensional tolerances, it did not perform satisfactorily with the normal tolerance range of such cables. For example, if the cable used had a thickness near the maximum of the tolerance range, the grounding pin could be inserted, if at all, only with great difficulty. On the other hand, if the cable dimension was at the minimum end of the range, the pin could be inserted too easily. While a grounding connection was initially provided, the cable jacket material could experience cold flow with age causing an interruption of the grounding circuit.

SUMMARY OF THE INVENTION

Among the several aspects of the present invention may be noted the provision of an improved connector assembly and its method of use. The connector assembly, which in one embodiment provides a grounding system for a cable shield, is usable with commonly available cable. More specifically, it compensates for cables having thicknesses near the ends of the normal tolerances range to provide an easy to complete grounding system which maintains its effectiveness with age. In another embodiment, the connector assembly of the present invention provides simplified insertion of an oversized cable into the cable passageway of the housing of a connector. The connector assembly is simple to form and use, is reliable in use and has long service life, and is simple and economical to manufacture. Other objects and features of the present invention will be, in part, apparent and, in part, pointed out in the following specification and claims and in the accompanying drawings.

Briefly, the connector assembly of the present invention includes a connector including an insulative housing defining a cable-receiving passageway, a cable positioned in the passageway and a metallic band, at least partially encompassing the cable, disposed in the passageway. The housing further includes a connection chamber communicating with the passageway and at least one metallic terminal element disposed in the chamber, with the element having a conductor termination portion and a component connection portion. The cable has a metallic conductor about which is disposed an insulative jacket with the conductor engaged by the connector termination portion of the terminal element. The metallic band is electrically isolated from the terminal element.

As a method of providing a grounding circuit for a connector, the subject invention concludes several steps:

(a) A metallic band having a spring characteristic is crimped over the cable so that it engages the cable shield and the cable has a predetermined cross-sectional dimension.

(b) The cable is inserted into the cable receiving passageway of the connector housing until the banded portion of the cable is in proper alignment for forming the grounding system of the connector assembly.

(c) A metallic grounding conductor is inserted into the passageway to cause compression of the metallic band thereby completing the grounding system of the connector assembly.

BRIEF DESCRIPTION OF THE DRAWINGS

Corresponding reference characters indicate corresponding components throughout the several views of the drawings.

DESCRIPTION OF THE PREFERRED EMBODIMENT

Figure 2:
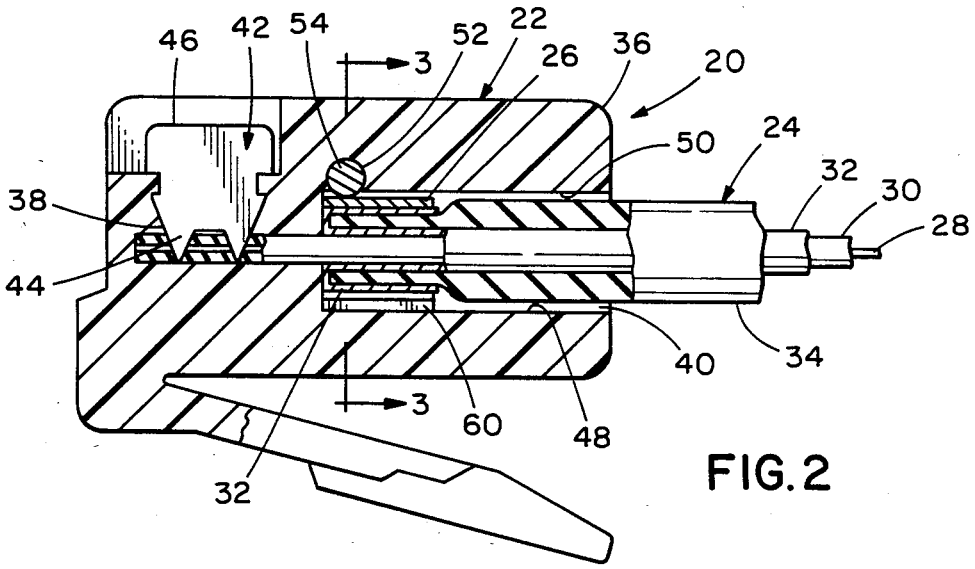
FIG. 2 is a side elevational view, partially in section, of one embodiment of the connector assembly of the present invention including a modular connector, a shielded cable and a metallic band disposed about the cable.

Referring now to the drawings, one embodiment of the connector assembly of the present invention for use in interconnecting a pair of electrical components, is generally indicated in FIG. 2 by reference character 20. The assembly comprises a modular connector 22 having a grounding means 54, a shielded cable 24 and a metallic band 26 positioned about the cable for electrically connecting the cable shield with the grounding means to provide the connector assembly with a grounding system. Such a connector assembly provides electromagnetic interference and radio frequency interference protection for equipment such as computers and their peripherals, point-of-sale and process control equipment incorporating microprocessors, and video game equipment.

More specifically, the cable 24 could be a shielded flat cable of the type including a number of parallel, spaced conductors 28 embedded in an insulator 30. A conductive shield 32 of braided copper wire or aluminum foil encompasses the insulator 30, and the cable also includes an outer insulative jacket 34.

The connector 22 is preferably of the modular plug type, including a one-piece insulative housing 36 defining a connection chamber 38 and a cable-receiving passageway 40 communicating with the chamber. The connector 22 also includes a metallic terminal element 42 for each conductor 28, with each element having a termination portion 44 for engaging its corresponding conductor 28, and a contact portion 46 which is exposed so that when the connector is plugged into the piece of equipment to be connected, each contact portion is engaged by a corresponding terminal in the piece of equipment to complete the appropriate circuits. A similar connector, but without a grounding system, is disclosed in U.S. Pat. No. 3,860,316, the teachings of which are hereby incorporated by reference.

The cable-receiving passageway can be considered to be formed, in part, by a floor 48 and a ceiling 50. The connector housing 36 further has a grounding circuit aperture 52 intersecting passageway 40 adjacent the ceiling 50 and spaced from the chamber 38 to insure electrical isolation of the grounding system from the terminal elements 42. Extending through the aperture and into the passageway is a metallic grounding pin 54 for connection to a system ground.

Figure 3:
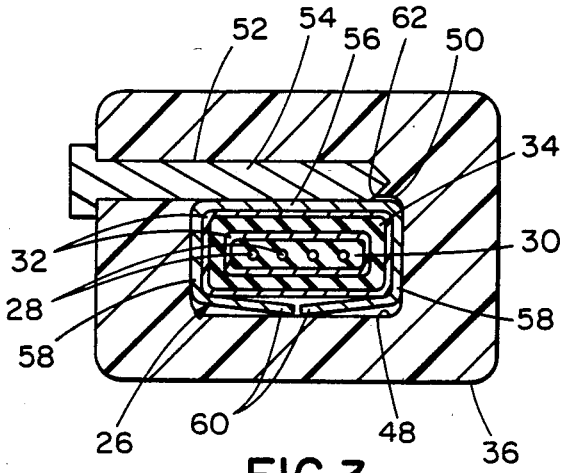
FIG. 3 is a sectional view taken generally along line 3—3 of FIG. 2.

The band 26 is applied, preferably by crimping, about the cable to engage the shield 32 at a cable location in alignment with the aperture 52. The band, which is preferably formed of a strong resilient metal such as phospher bronze, brass or beryllium copper, may be of a channel shape including a web 56 overlying the cable, and a pair of generally parallel legs 58 extending alongside the cable as shown in FIG. 3. The band is provided with spring means in the form of an inwardly extending spring arm 60 extending from each leg which, when the banded cable is received in the passageway, contacts the floor 48. The uncompressed height of the cable with the band, i.e., from the top of the web to the distal ends of the spring arms, is preferably slightly greater than the spacing between the bottom of the grounding pin aperture 52 and the housing floor 48. Accordingly, when the pin is installed into the connector with the banded cable properly positioned in the passageway, the band becomes compressed between the pin and the floor as shown in FIG. 3. To facilitate insertion of the pin, the leading pin end is provided with a ramp surface 62 for deflecting the band below the level of the pass path of the grounding pin 54. Since the band is maintained in compression between the pin and the floor, it is concurrently biased into firm mechanical engagement with both the cable shield and the pin, thereby establishing a reliable grounding system in the connector assembly.

Figure 1:
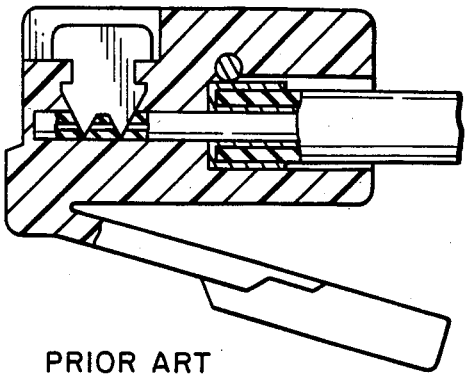
PRIOR ART FIG.1
FIG. 1 is a side elevational view, partially in section, of a prior art connector assembly incorporating a grounding system.

This is in sharp contrast to the operation of the prior art connector assembly shown in FIG. 1 which relies upon an interference fit of the grounding pin against the flat cable with the shield folded back over the outer jacket. The prior art connector assembly works acceptably for a flat cable having a preselected cable thickness. However, flat cables have a normal thickness tolerance range, which may be in order of plus or minus 10%. If the cable desired to be used with the prior art connector had a thickness at the upper end of the tolerance range, it would extend far above the level of the grounding pin aperture thus making it extremely difficult, if not functionally impossible, to insert the grounding pin. On the other hand, if the cable selected for use with the prior art connector had a thickness near the bottom of the tolerance range, the insertion force would be acceptably low and there would initially be a reliable connection, however, with time the insulative materials of the cable could thin due to cold flow. Thus the resiliency of the cable would be lost and there could be an interruption of the grounding system supplied by the prior art connector assembly.

The connector assembly of the present invention, on the other hand, maintains reliable grounding connections between the grounding pin 54 and the shield of the cable by the provision of the spring means, i.e., the spring arms 60, of the metallic band 26. The metallic band is crimped onto the cable in contact with the folded back shield to such an extent that the banded portion of the cable has a predetermined cross-sectional dimension, i.e., thickness. This thickness is selected to offer low insertion force for the grounding pin while the spring arms maintain good contact between the various components of the grounding system of the connector assembly. More specifically, the range of thickness for a particular flat cable might be from 0.095 inch to 0.118 inch, a tolerance range of about 20%. With the metallic band (which may itself have a thickness in the range of 0.008 to 0.01 inch) installed, the tolerance range of thickness at the band installation could be held from 0.097 inch to 0.099 inch, a range of only about 2%. Thus, with the use of the band, not only is spring biasing of the various contact members of the grounding system achieved, but the tolerance range of the thickness of the cable is reduced by an order of magnitude.

Figure 4:
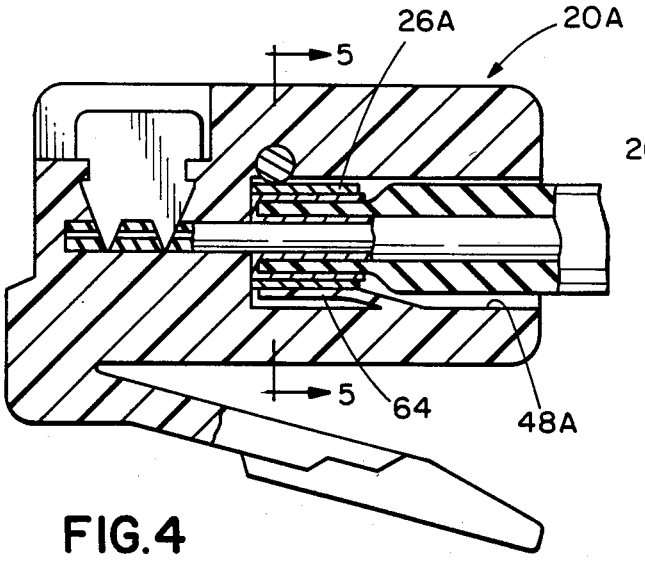
FIG. 4, similar to FIG. 3, shows an alternative embodiment of the band and the connector of the present invention.
Figure 5:
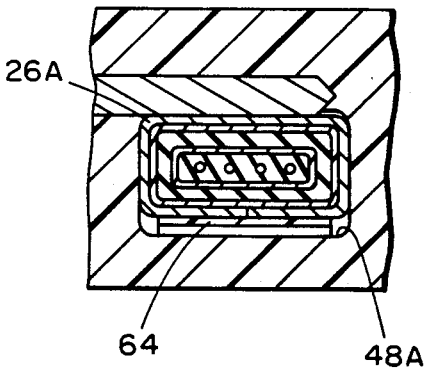
FIG. 5 is a sectional view taken generally along line 5—5 of FIG. 4.

Referring to FIG. 4, an alternative embodiment of the connector assembly of the present invention is shown generally at reference character 20A. Components of this alternative embodiment, corresponding to components of the connector assembly 20 previously described are identified by application of the reference character applied to the first embodiment followed by the suffix "A". The main distinction between the second embodiment and that previously described is that the spring force used to maintain good contact among the various components of the grounding system of the connector assembly is, in large part, provided by a spring means extending from the floor 48A forming passageway 40A. This spring means, which is shown as a resilient tongue 64, may be integral with the connector housing. The band 26A used is endless and, while it may provide a certain amount of spring force due to the fact that it contains acurate portions, the curvature of which are changed between the uncompressed and compressed states of the band, it is the combination of the components which provide the spring force which maintain a reliable grounding system. It will be appreciated that various components of the band and/or connector housing can be used to provide the necessary resilient biasing.

As a method of providing a grounding circuit for a connector 20, the present invention includes the following steps:

(a) A metallic band 26 having a spring characteristic is crimped over the cable so as to engage the cable shield. It is crimped to such an extent that the applied band has a predetermined cross-sectional dimension which is slightly greater than the spacing between the grounding pin-receiving aperture 52 and the floor 48 partially defining the cable-receiving passageway.

(b) the banded cable is inserted into the passageway until the band is aligned between the aperture and the floor.

(c) A metallic grounding conductor is inserted through the aperture and into the passageway to cause the band to be compressed between the conductor and the floor.

As will be apparent to those of skill in the art, the termination of the various conductors of the flat cable could be achieved by discrete termination, or by mass termination methods.

The present invention is not limited to shielded cable applications. The present invention contemplates the application of a band about a cable to give the banded cable portion a predetermined cross-sectional dimension. This is also particularly useful where the connector has a housing defining a cable receiving passageway which has a cross-sectional dimension smaller than the corresponding cross-sectional dimension of the as-manufactured cable. The application of the band and its crimping to such an extent to reduce the corresponding cross-sectional dimension of the banded cable portion below that of the cable in its as-manufactured condition, facilitates entrance of the cable into the cable-receiving passageway of the connector housing.

In view of the above, it will be seen that the several objects of the invention are achieved and other advantageous results attained.

As various changes could be made without departing from the scope of the invention, it is intended that all matter contained in the above description shall be interpreted as illustrative and not in a limiting sense.

What is claimed is:

1. A connector assembly for use in interconnecting a pair of electrical components, said assembly comprising:

a connector including an insulative housing defining a connection chamber and a cable-receiving passageway communicating with said chamber, and further including at least one metallic terminal element disposed in said chamber, said element having a conductor termination portion and a component connection portion;

a shielded cable disposed in said passageway, said cable including a metallic conductor engaged by said conductor termination portion with a metallic shield disposed about and insulated from said conductor and an insulative jacket disposed about said shield;

a resilient metallic band, at least partially encompassing said cable and engaging a portion of said shield folded back over said jacket, disposed in said passageway and electrically isolated from said terminal element; and a metallic grounding pin extending inside said passageway and compressing said band.

2. A connector assembly for use in interconnecting a pair of electrical components, said assembly comprising:

a connector including an insulative housing defining a connection chamber and a cable-receiving passageway communicating with said chamber, and further including at least one metallic terminal element disposed in said chamber, said element having a conductor termination portion and a component connection portion;

a cable disposed in said passageway, said cable including a metallic conductor engaged by said conductor termination portion and an insulative jacket disposed about said conductor; and a metallic band, at least partially encompassing said cable, disposed in said passageway and electrically isolated from said terminal element, said passageway being defined by a floor and a ceiling, said band having resilient spring means said spring means including a resiliently deflectable arm having a distal end for engaging said floor, insertion of a pin between said ceiling and said band pushing said band towards said floor and deflecting said spring arm to compress said band about said cable whereby said cable is firmly held between said floor and ceiling.

3. An assembly as set forth in claim 2 wherein said housing includes an aperture intersecting said passageway at a location spaced from said floor.

4. An assembly as set forth in claim 3 further comprising a metallic contact extending through said aperture and into said passageway with said band being compressed between said contact and said floor.

5. An assembly as set forth in claim 4 wherein said contact is said pin, one of said pin and said band having a ramp surface for deflecting said band toward said floor upon inserting of said pin into said passageway.

6. An assembly as set forth in claim 5 wherein said cable is a shielded cable and wherein said pin is electrically connected to said shield through said band.

7. An assembly as set forth in claim 2 wherein said band is generally channel-shaped having a web disposed adjacent said ceiling, and a pair of generally parallel legs.

8. An assembly as set forth in claim 7 wherein one of said legs carries said spring arm.

9. A connector assembly for use in interconnecting a pair of electrical components, said assembly comprising:

a connector including an insulative housing defining a connection chamber and a cable-receiving passageway communicating with said chamber, and further including at least one metallic terminal element disposed in said chamber, said element having a conductor termination portion and a component connection portion;

a cable disposed in said passageway, said cable including a metallic conductor engaged by said conductor termination portion and an insulative jacket disposed about said conductor; and a metallic band, at least partially encompassing said cable, disposed in said passageway and electrically isolated from said terminal element, said passageway being defined by a floor and a ceiling, said floor having resilient spring means and said band engaging said spring means.

10. An assembly as set forth in claim 9 wherein said band is endless.

* * * * *

UNITED STATES PATENT AND TRADEMARK OFFICE

CERTIFICATE OF CORRECTION

PATENT NO. : 4,566,745

DATED : January 28, 1986

INVENTOR(S) : Ronald R. Maros

It is certified that error appears in the above-identified patent and that said Letters Patent is hereby corrected as shown below:

Column 2, Line 27: "cable receiving" should read --cable-receiving--.

Column 4, Line 58: "acurate" should read --arcuate--.

Column 5, Line 8: "the" should read --The-- (first occurrence).

Signed and Sealed this

*Third* Day of *June 1986*

[SEAL]

*Attest:*

DONALD J. QUIGG

*Attesting Officer*

*Commissioner of Patents and Trademarks*